US009045940B2

(12) United States Patent
Walters

(10) Patent No.: US 9,045,940 B2
(45) Date of Patent: Jun. 2, 2015

(54) PAINT CAN SHELF FOR EXTENSION LADDERS

(71) Applicant: David Walters, Apple Valley, CA (US)

(72) Inventor: David Walters, Apple Valley, CA (US)

( * ) Notice: Subject to any disclaimer, the term of this patent is extended or adjusted under 35 U.S.C. 154(b) by 0 days.

(21) Appl. No.: 14/292,519

(22) Filed: May 30, 2014

(65) Prior Publication Data

US 2014/0353446 A1 Dec. 4, 2014

Related U.S. Application Data

(60) Provisional application No. 61/830,534, filed on Jun. 3, 2013.

(51) Int. Cl.
*E06C 7/14* (2006.01)

(52) U.S. Cl.
CPC ..... *E06C 7/143* (2013.01)

(58) Field of Classification Search
CPC ..... E06C 7/14; E06C 7/143
USPC ..... 248/210; 182/129; 211/85.21, 86.01
See application file for complete search history.

(56) References Cited

U.S. PATENT DOCUMENTS

| | | | | | |
|---|---|---|---|---|---|
| 3,160,383 | A | * | 12/1964 | Lamm | 248/211 |
| 3,223,369 | A | | 12/1965 | Benninger, Jr. | |
| 3,229,943 | A | | 1/1966 | Olson | |
| 3,312,441 | A | * | 4/1967 | Molenda | 248/210 |
| 3,495,683 | A | | 2/1970 | Broden | |
| 3,814,364 | A | * | 6/1974 | Gargaro | 248/210 |
| 4,016,955 | A | * | 4/1977 | Gates | 182/122 |
| 4,071,214 | A | * | 1/1978 | Reidy | 248/211 |
| 4,445,659 | A | | 5/1984 | LaChance | |
| 4,489,911 | A | * | 12/1984 | Riley | 248/238 |
| 4,527,763 | A | | 7/1985 | Woytowich | |
| 4,624,430 | A | * | 11/1986 | Ehmke | 248/211 |
| 4,662,594 | A | | 5/1987 | Dubis | |
| 4,824,060 | A | | 4/1989 | Korda | |
| 4,899,970 | A | * | 2/1990 | Berzina | 248/210 |
| 4,913,394 | A | * | 4/1990 | Schmid | 248/238 |
| 5,133,525 | A | * | 7/1992 | Good | 248/210 |
| 5,135,193 | A | * | 8/1992 | Parris | 248/238 |
| 5,181,682 | A | | 1/1993 | Indelicato | |
| 5,191,954 | A | | 3/1993 | Ledford | |
| 5,259,525 | A | | 11/1993 | Wion | |
| 5,358,071 | A | * | 10/1994 | Stennett | 182/214 |
| 5,461,752 | A | | 10/1995 | Lemon et al. | |
| 5,797,571 | A | * | 8/1998 | Brophy | 248/210 |
| 5,855,346 | A | | 1/1999 | Hall | |
| 5,934,632 | A | * | 8/1999 | Weaver | 248/210 |
| 5,950,762 | A | * | 9/1999 | George | 182/129 |

(Continued)

FOREIGN PATENT DOCUMENTS

| | | | | |
|---|---|---|---|---|
| WO | WO 90/04081 | * | 4/1990 | E06C 7/14 |

*Primary Examiner* — Michael Safavi
(74) *Attorney, Agent, or Firm* — Kenneth L. Green; Averill & Green

(57) ABSTRACT

A paint can shelf attaches to a sliding extension ladder fly section. The shelf includes two parallel arms which reach through hollow rungs of the sliding extension ladder fly section, whereby the shelf is raised and lowered with the sliding extension ladder fly section. Slides are attached to the arms on each side of the sliding extension ladder fly section and include low friction surfaces facing the fixed extension ladder section. The slides allow somewhat loose tolerances in the engagement of the arms with the ladder preventing the ladder sections from binding when the ladder is extended or lowered.

20 Claims, 4 Drawing Sheets

(56) References Cited

U.S. PATENT DOCUMENTS

| | | | | |
|---|---|---|---|---|
| 5,960,905 | A * | 10/1999 | Gardner | 182/129 |
| 6,264,151 | B1 | 7/2001 | Schiller | |
| 6,352,135 | B1 | 3/2002 | Jones | |
| 6,431,509 | B1 * | 8/2002 | Proulx | 248/210 |
| 6,824,115 | B1 | 11/2004 | Batson | |
| 7,607,623 | B2 | 10/2009 | Wesolowski | |
| 7,967,264 | B1 * | 6/2011 | Peterson | 248/210 |
| 8,469,148 | B2 * | 6/2013 | Perry | 182/129 |
| 8,672,279 | B2 | 3/2014 | Schirmacher et al. | |
| 2003/0196854 | A1 * | 10/2003 | Beczak, Sr. | 182/129 |
| 2005/0194213 | A1 * | 9/2005 | Beczak, Sr. | 182/129 |
| 2006/0196999 | A1 * | 9/2006 | Owens et al. | 248/210 |
| 2007/0235606 | A1 * | 10/2007 | Corson | 248/210 |
| 2008/0035426 | A1 * | 2/2008 | Leuthner | 182/129 |
| 2008/0061201 | A1 * | 3/2008 | Sasser | 248/210 |
| 2009/0308996 | A1 * | 12/2009 | Hohensee | 248/238 |
| 2010/0237207 | A1 | 9/2010 | Cabral | |
| 2011/0203873 | A1 | 8/2011 | Perry | |
| 2012/0187266 | A1 | 7/2012 | Schirmacher et al. | |
| 2013/0192924 | A1 * | 8/2013 | Paun | 182/129 |

* cited by examiner

PAINT CAN SHELF FOR EXTENSION LADDERS

CROSS-REFERENCE TO RELATED APPLICATIONS

The present application claims the priority of U.S. Provisional Patent Application Ser. No. 61/830,534 filed Jun. 3, 2013, which application is incorporated in its entirety herein by reference.

BACKGROUND OF THE INVENTION

The present invention relates to extension ladder accessories and in particular to a paint can shelf attachable to a sliding extension ladder fly section.

Painters have been faced with the problem of supporting a paint can on an extension ladder for many years. Various holders have been developed and marketed, but none have succeeded to provide a good solution.

BRIEF SUMMARY OF THE INVENTION

The present invention addresses the above and other needs by providing an extension ladder paint can shelf which attaches to a sliding extension ladder fly section and slides against a fixed extension ladder section. The shelf includes two parallel arms which reach through hollow rungs of the sliding extension ladder fly section, whereby the shelf is raised and lowered with the sliding extension ladder fly section. Slides are attached to the arms on each side of the sliding extension ladder fly section and include low friction surfaces facing the fixed extension ladder section. The slides allow somewhat loose tolerances in the engagement of the arms with the ladder preventing the ladder sections from binding when the ladder is extended or lowered.

In accordance with one aspect of the invention, the extension ladder paint can shelf includes a slide residing against a face of an extension ladder base section side rail. The hollow rungs of the fly section of the extension ladder are only slightly displaced outward from the face and typical extension ladder tolerance do not facilitate an extension ladder paint can shelf spaced outward from the face of the base section side rail. To prevent binding when the ladder is extended or lowered, a low friction material is attached to the side of the slider facing the rail face. The material may be, for example, metal, plastic, TEFLON® material, TURCITE® material, and the like.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
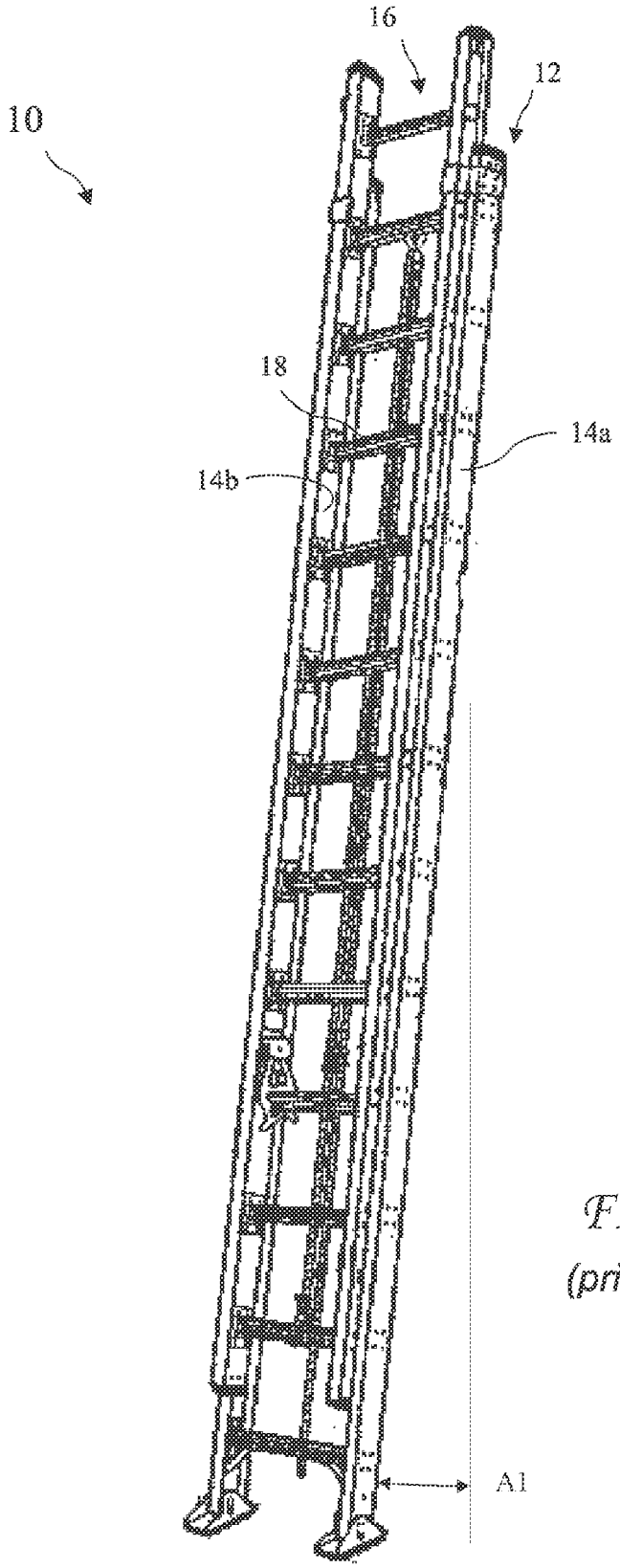
FIG. 1 (prior art)
FIG. 1 shows a perspective view of a prior art extension ladder.

A perspective view of a prior art extension ladder 10 is shown in FIG. 1. The extension ladder 10 includes a stationary base section 12 and an extending fly section 16. The base section 12 include a base section side rails 14*a*, and the fly section 14 includes fly section slide rails 14*b*, and hollow rungs 18. The fly section 16 can be lowered to generally align with the base section 12 for a minimum ladder length, or can be extended with respect to the base section 12 to obtain a longer ladder 10. The ladder 10 is leaned at an angle A1 during use to provide stability. The angle A1 is preferably 13 to 17 degrees from vertical.

Figure 2:
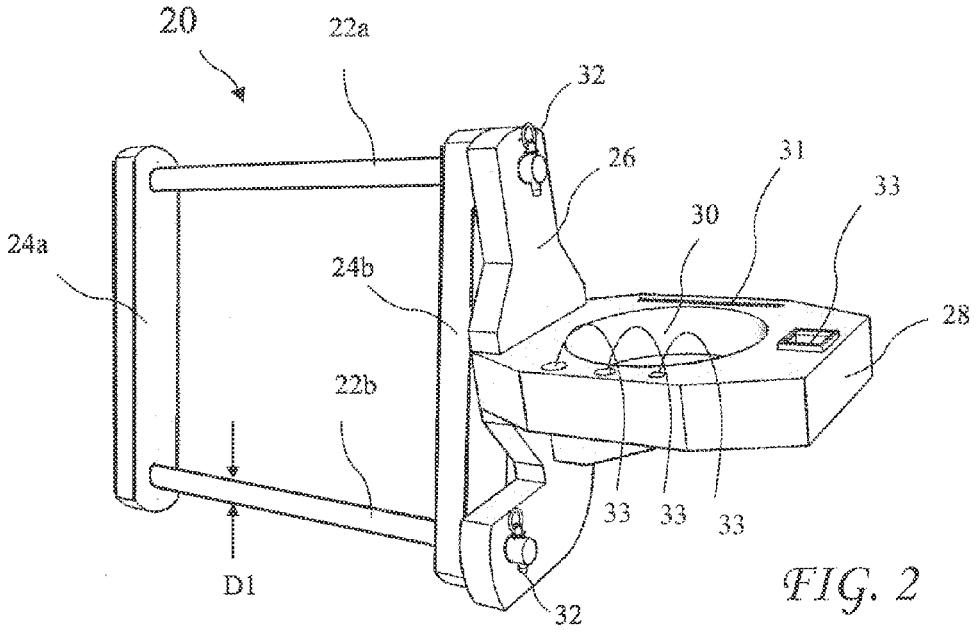
FIG. 2 shows a perspective view of a paint can shelf according to the present invention for use with the extension ladder.
Figure 3:
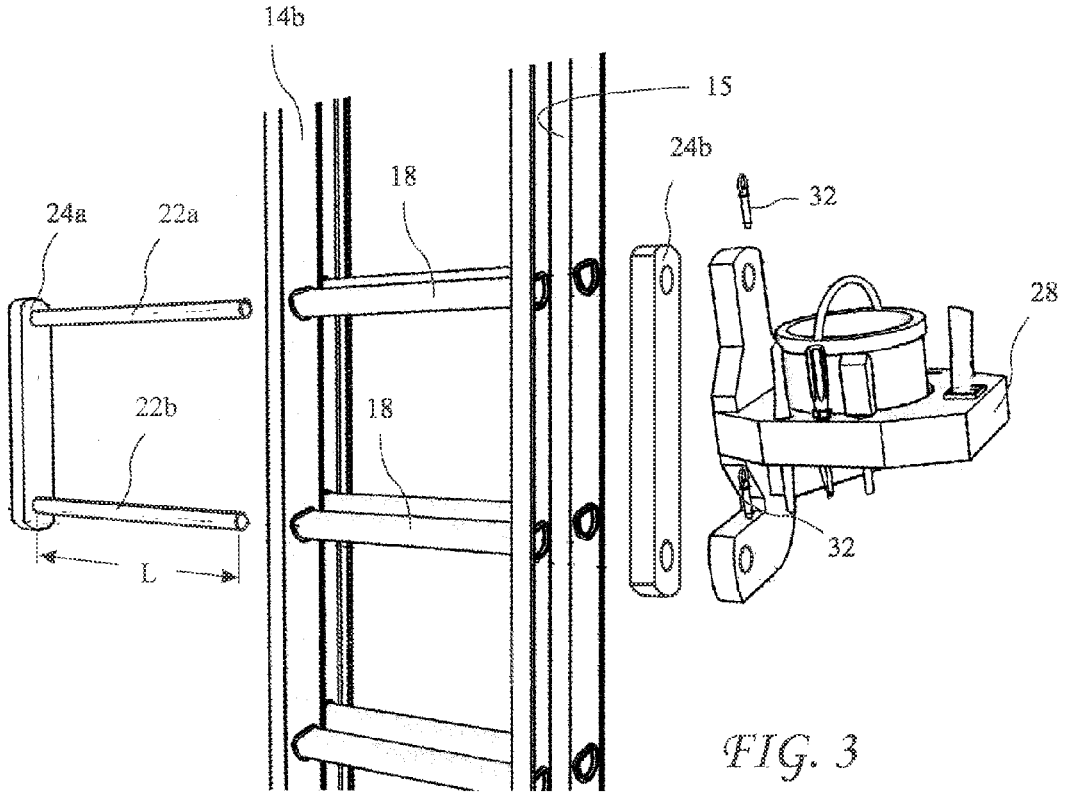
FIG. 3 shows an exploded perspective view of the paint can shelf according to the present invention with the extension ladder.
Figure 4A:
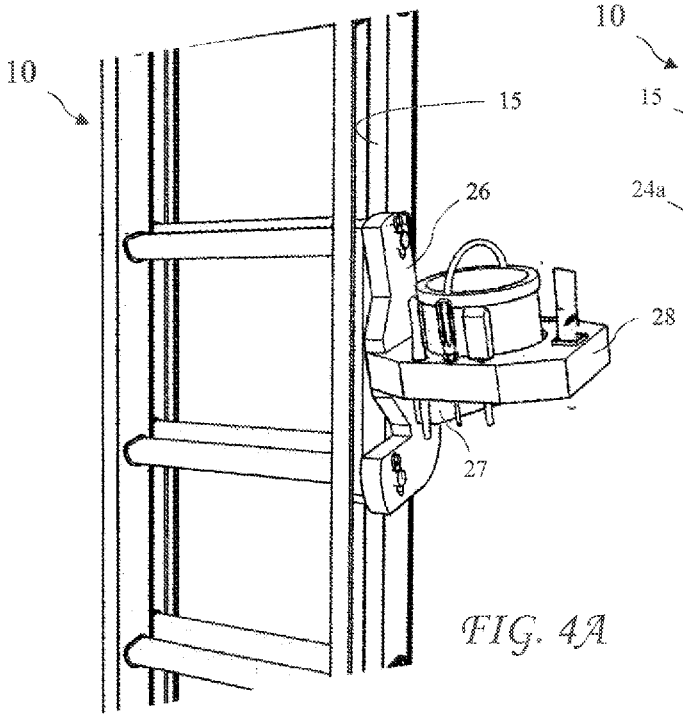
FIG. 4A shows a perspective view of the assembled paint can shelf according to the present invention attached to the extension ladder.
Figure 4B:
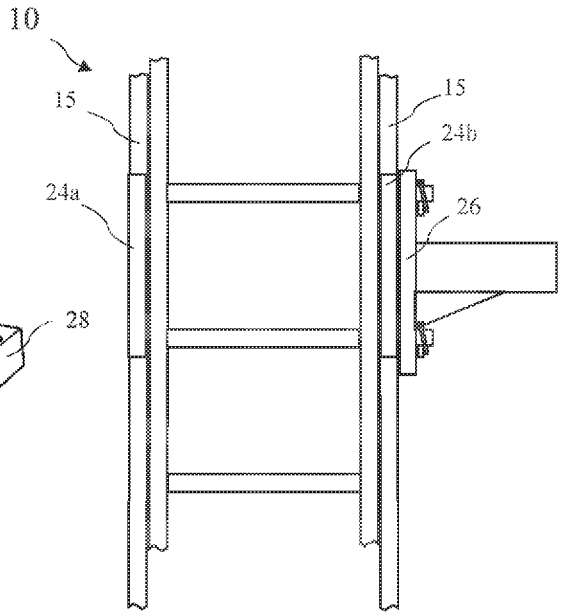
FIG. 4B shows a front view of the assembled paint can shelf according to the present invention attached to the extension ladder.

A perspective view of a paint can shelf 20 according to the present invention, for use with the extension ladder 10, is shown in FIG. 2, an exploded perspective view of the paint can shelf 20 is shown in FIG. 3, a perspective view of the assembled paint can shelf 20 attached to the extension ladder 10 is shown in FIG. 4A, and a front view of the assembled paint can shelf 20 attached to the extension ladder 10 is shown in FIG. 4B. The paint can shelf 20 includes a first slide 24*a* on a left side of the paint can shelf 20, parallel upper arm 22*a* and lower arm 22*b*, a second slide 24*b* opposite to the first slide 24*a*, a bent leg 26, and a shelf 28. The arms 22*a* and 22*b* may be permanently attached to the first slide 24*a*, or attachable to the first slide 24*a*, and when attached to the first slide 24*a*, extends a length L from the first slide 24*a*, the length L preferably about 18 and ¾ inches. The arms 22*a* and 22*b* extend through the hollow rungs 18 of the extending fly section 16, passages 40*a* and 40*b* respectively (see FIG. 5A) of the second slide 24*b*, and through the bent leg 26 far enough to attach locks 32 to exposed ends of the arms 22*a* and 22*b*, retaining the bent leg 26, while positioning the slides 24*a* and 24*b* facing the faces 15 (see FIG. 4) of the base section side rail 14*a* (see FIG. 1), and sandwiching the extending fly section 16 of the ladder 10 between the slides 24*a* and 24*b*. The locks 32 may be pins, lynchpins, nuts, or any apparatus attachable to exposed ends of the arms 22*a* and 22*b*. A cylindrical recessed area 30 is configured to accept a paint can provided in the shelf 28. Additional features may be provided in the shelf 28, the features including a slot 31 accepts a scraping or putty knife or the like, and various passages 33 accept brushes and tools of various types, and the like. The arms 22*a* and 22*b* preferably have a diameter D1 of preferably one inch.

Figure 5A:
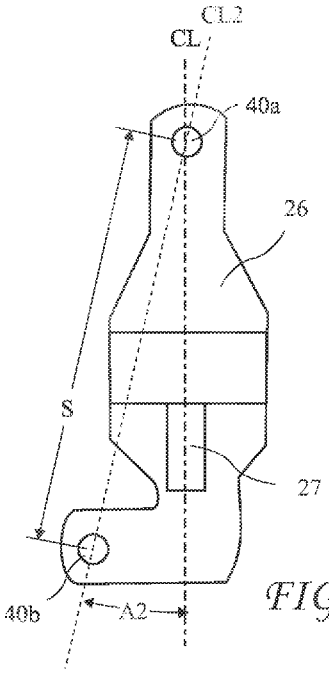
FIG. 5A is a side view of a bent elbow of the paint can shelf according to the present invention.
Figure 5B:
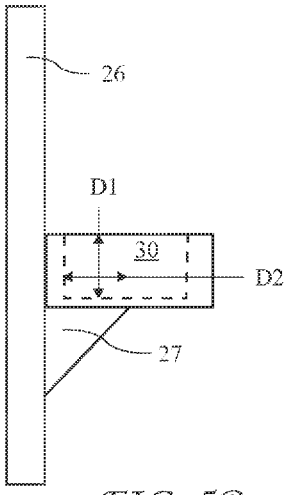
FIG. 5B is a front view of the bent elbow of the paint can shelf according to the present invention.

A side view of the bent elbow 26 is shown in FIG. 5A and a front view of the bent elbow 26 is shown in FIG. 5B. The bent elbow 26 includes two passages 40*a* and 40*n* for the arms 22*a* and 22*b*, the passages 40*a* and 40*b* spaced apart by a separation S of preferably between ten and fourteen inches and more preferably about twelve inches. The bent elbow 26 has a vertical centerline CL and the passages 40*a* and 40*b* are connected by a second centerline CL2. The centerlines CL and CL2 are separated by the angle A2 preferably matching the angle A1 of the extension ladder 10 to provide a generally horizontal shelf 28. A diagonal brace 27 provides support for the shelf 28. The angle A2 is preferably between 13 and 17 degrees and more preferably about 15 degrees. The recessed area 30 had a depth D1 and diameter D2 for receiving and holding the paint can. The depth D1 is preferably at least about three inches deep to prevent the paint can from escaping from the recess 30 when the ladder 10 is moved, and is more preferably about three inches deep, for example, between 2.5 and 3.5 inches deep. The diameter D2 is preferably between 6.5 and seven inches and more preferably at least about 6.5 inches and more preferably about 6.75 inches.

Figure 7A:
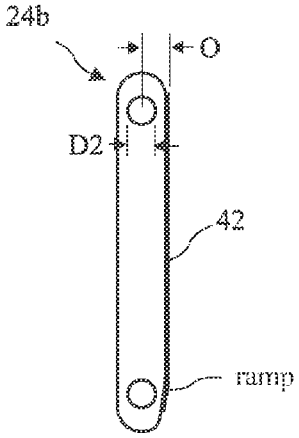
FIG. 7A shows a side view of the slide member of the paint can shelf according to the present.
Figure 7B:
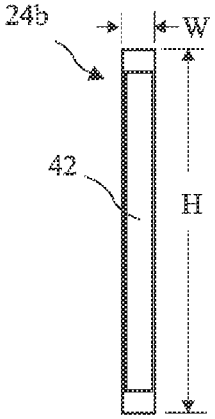
FIG. 7B shows a rear view of the slide member of the paint can shelf according to the present.
Figure 6:
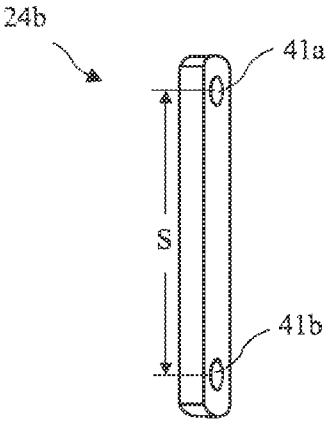
FIG. 6 shows a perspective view of a slide member of the paint can shelf according to the present.
Figure 9:
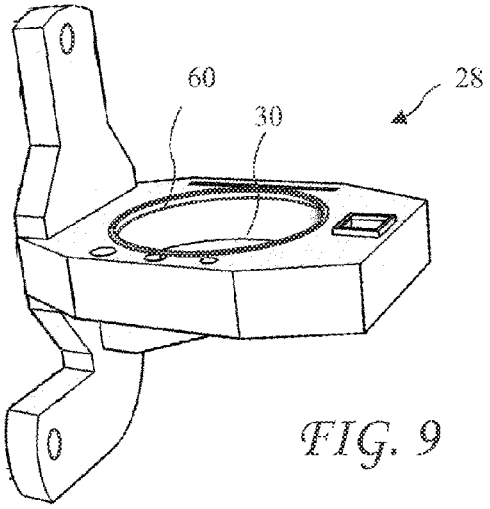
FIG. 9 shows a compressible ring according to the present invention around a top edge of a paint can recess in the paint can shelf.

A perspective view of the slide member 24*b* is shown in FIG. 6, a side view of the slide member 24*b* is shown in FIG. 7A, and a rear view of the slide member 24*b* is shown in FIG. 7B. The slide member 24*b* includes two passages 41*a* and 41*b* for the arms 22*a* and 22*b*, the passages 41*a* and 41*b* spaced apart by a separation S. A low friction plate 42 is attached to the rear surface of the slide member 24*b*, the plate 42 faces, or lays against, a face 15 (see FIG. 4) of the base section side rail 14*a*. A ramp 50 may be present at one or both ends of the slide member 24*b* and helps the slide member 24*b* to slide along the face 15.

The passages 41*a* and 41*b* have a diameter D2 of preferably about one inch and allow the arms 22*a* and 22*b* to slide through the passages 41*a* and 41*b*. The centers of the passages 41*a* and 41*b* are offset a distance O, of preferably about one inch, from the rear surface of the plate 42. The diameter D2 and offset O allow the paint can shelf 20 to slide on, or avoid contact with, the face 15 (see FIG. 4) of the base section side rail 14*a* when the ladder 10 is extended or lowered. The slide member 24*b* has a width W of preferably about 2¼ inches and a height H of preferably about fifteen inches. The slide member 24*a* preferably has the same dimensions D2, O, S, W, and H as the slide member 24*a* and may include a low friction plate 42. The low friction plate 42 may be made from TEFLON® material, TURCITE® material, a hard metal material, or the like. The slide member 24*a* (see FIG. 3) may have all or some of the features of the slide member 24*b* shown in FIGS. 6, 7A, and 7B.

Figure 8:
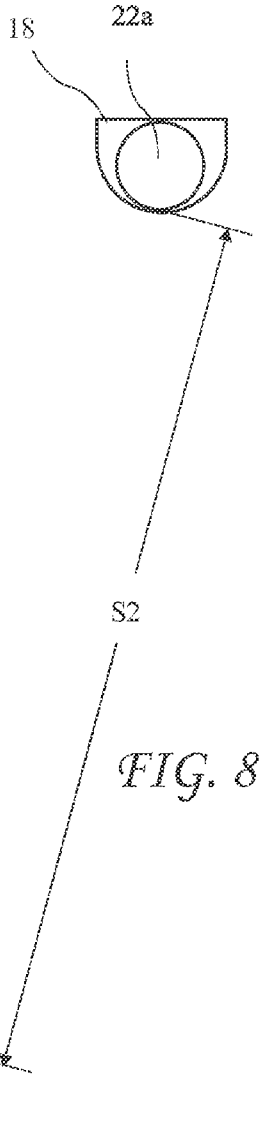
FIG. 8 shows a cross-sectional view of arms of the paint can shelf according to the present residing in ladder rungs.

A cross-sectional view of the arms 22*a* and 22*b* residing in the ladder rungs 18 is shown in FIG. 8. In one popular ladder 10 the arms are preferably spaced apart a separation S2 of about eleven inches, and the arms 22*a* and 22*b* are preferably about one inch in diameter.

A compressible ring 60 is insertable into the recess 30 in the shelf 28. The ring 60 provides an interference fit to better hold a one gallon paint can in the recess 30.

The paint can shelf 20 described above is a preferred design for a right handed painter, another embodiment for a left handed painter is a mirror image of the paint can shelf 20. An example of a suitable material for the paint can shelf 20 is polycarbonate sold under the trademark LEXAN.

While the invention herein disclosed has been described by means of specific embodiments and applications thereof, numerous modifications and variations could be made thereto by those skilled in the art without departing from the scope of the invention set forth in the claims.

I claim:

1. A paint can shelf for attachment to an extending fly section of an extension ladder, the shelf comprising:

two parallel horizontal arms spaced vertically apart to jointly engage hollow rungs of a sliding extension ladder fly section;

a first slide having two parallel first sockets configured to receive first ends of the horizontal bars;

a second slide having two parallel second sockets configured to receive second ends of the horizontal bars opposite to the first ends;

a bent leg having two parallel third sockets configured to receive second ends of the horizontal bars opposite to the first ends; and a shelf attached to the bent leg, the shelf aligned at an angle A2 with respect to a centerline CL2 intersecting the third sockets to place the shelf generally horizontally when the extension ladder is in use.

2. The paint can shelf of claim 1, wherein the shelf is aligned at an angle A2 between 13 and 17 degrees with respect to the centerline CL2 intersecting the third sockets to place the shelf generally horizontally when the extension ladder is in use.

3. The paint can shelf of claim 2, wherein the shelf is aligned at an angle A2 of about 15 degrees with respect to the centerline CL2 intersecting the third sockets to place the shelf generally horizontally when the extension ladder is in use.

4. The paint can shelf of claim 1, wherein the horizontal arms are fixedly attached to the first slide.

5. The paint can shelf of claim 4, wherein the horizontal arms are detachably attachable to the second side and the bent leg by lynchpins inserted through the second ends of the horizontal arms.

6. The paint can shelf of claim 1, wherein two parallel horizontal arms spaced vertically apart to jointly engage consecutive hollow rungs of a sliding extension ladder fly section.

7. The paint can shelf of claim 6, wherein two parallel horizontal arms spaced vertically apart between ten and fourteen inches.

8. The paint can shelf of claim 7, wherein two parallel horizontal arms spaced vertically apart about twelve inches.

9. The paint can shelf of claim 1, wherein the shelf includes a recess in a top surface of the shelf for a paint can.

10. The paint can shelf of claim 9, wherein the recess is for a one gallon paint can.

11. The paint can shelf of claim 10, wherein the recess is at least 6.5 inches in diameter.

12. The paint can shelf of claim 11, wherein the recess is between 6.5 and seven inches in diameter.

13. The paint can shelf of claim 11, wherein the recess is between 2.5 and 3.5 inches deep.

14. The paint can shelf of claim 11, wherein the recess is at least about 3 inches deep.

15. The paint can shelf of claim 11, wherein the recess is about 3 inches deep.

16. The paint can shelf of claim 15, further including a compressible ring residing in the recess.

17. The paint can shelf of claim 1, wherein:

the slides include a surface generally parallel to the centerline CL2 intersecting the third sockets, the surface extending most of the length of the slides and facing a face of a base section side rail of the extending fly section; and a low friction plate attached to the surface.

18. The paint can shelf of claim 17, wherein a ramp is formed on at least one end of the surface.

19. A paint can shelf for attachment to an extending fly section of an extension ladder, the shelf comprising:

two parallel horizontal arms spaced apart a separation S of about 12 inches between centerlines to jointly engage consecutive hollow rungs of a sliding extension ladder fly section;

a first slide having two parallel first sockets configured to receive first ends of the horizontal bars;

a second slide having two parallel second sockets configured to receive second ends of the horizontal bars opposite to the first ends;

a bent leg having two parallel third sockets configured to receive second ends of the horizontal bars opposite to the first ends;

a shelf attached to the bent leg, the shelf aligned at an angle A2 between 13 and 17 degrees with respect to a centerline CL2 intersecting the third sockets to place the shelf generally horizontally when the extension ladder is in use; and a cylindrical recess in a top surface of the shelf between 6.5 and seven inches in diameter and between 2.5 and 3.5 inches deep.

20. A paint can shelf for attachment to an extending fly section of an extension ladder, the shelf comprising:

two parallel horizontal arms about one inch in diameter and spaced apart a separation S2 of about 11 inches to jointly engage consecutive hollow rungs of a sliding extension ladder fly section;

a first slide having two parallel first sockets configured to receive first ends of the horizontal bars;

a second slide having two parallel second sockets configured to receive second ends of the horizontal bars opposite to the first ends;

a bent leg having two parallel third sockets configured to receive second ends of the horizontal bars opposite to the first ends;

a shelf attached to the bent leg, the shelf aligned at an angle A2 between 13 and 17 degrees with respect to a centerline CL2 intersecting the third sockets to place the shelf generally horizontally when the extension ladder is in use; and a cylindrical recess in a top surface of the shelf about 6.75 inches in diameter and between 2.5 and 3.5 inches deep.

* * * * *